United States Patent [19]

Bedford

[11] Patent Number: 4,825,488

[45] Date of Patent: May 2, 1989

[54] SUPPORT PAD FOR NONAMBULATORY PERSONS

[76] Inventor: Peter H. Bedford, 3817 Mistral Ave., Huntington Beach, Calif. 92649

[21] Appl. No.: 180,894

[22] Filed: Apr. 13, 1988

[51] Int. Cl.[4] ..... A47C 21/04

[52] U.S. Cl. ..... 5/469; 5/465; 5/481

[58] Field of Search ..... 5/469, 468, 423, 481, 5/465; 297/453, 180

[56] References Cited

U.S. PATENT DOCUMENTS

| | | | |
|---|---|---|---|
| 2,400,790 | 5/1946 | Tolen | 5/469 X |
| 2,493,067 | 1/1950 | Goldsmith | 5/423 |
| 3,266,064 | 8/1966 | Figman | 5/469 |
| 3,486,177 | 12/1969 | Marshack | 297/453 |
| 3,644,950 | 2/1972 | Lindsay | 5/469 X |
| 3,757,366 | 9/1973 | Sacher | 5/423 |
| 4,686,724 | 8/1987 | Bedford | 5/468 |
| 4,741,058 | 5/1988 | Williams | 5/468 |

FOREIGN PATENT DOCUMENTS

| | | | |
|---|---|---|---|
| 1910954 | 9/1970 | Fed. Rep. of Germany | 5/423 |

*Primary Examiner*—Gary L. Smith
*Assistant Examiner*—Michael J. Milano
*Attorney, Agent, or Firm*—Price, Gess & Ubell

[57] ABSTRACT

A foam support pad for nonambulatory persons provides for an even weight distribution and maximum aeration of skin areas in contact with the pad to prevent the formation of decubitus ulcers. The top surface of the pad has an array of protuberances and valleys thereon. Electric fans disposed throughout the pad boost airflow to the skin areas in contact with the pad. Portions of the pad are detachable along perforations to allow the insertion of pad sectors capable of accommodating a plurality of fans.

12 Claims, 2 Drawing Sheets

SUPPORT PAD FOR NONAMBULATORY PERSONS

BACKGROUND OF THE INVENTION

1. Field of the Invention

The present invention relates to specialty pads, and more particularly pertains to padding used by nonambulatory persons as bed pads to distribute the contact between parts of their body and a reclining surface, and further, to maximize aeration of body parts in contact with the pad. Proper weight distribution and adequate aeration can prevent the occurrence of decubitus ulcers and aid in the healing process once an ulcer has formed.

2. Description of the Prior Art

Decubitus ulcers or pressure sores can form on parts of the body where blood circulation is restricted due to the application of pressure thereon. For a patient in repose, such pressures are typically applied by the body weight to skin areas overlying bony prominences such as the sacrum, the shoulder blades, the spine, the elbows and the heels. The restriction of blood flow reduces the amount of oxygen and nutrients available to the affected tissue and causes waste to accumulate. Cells die, the tissue degenerates, and an open festering wound develops.

Those concerned with manufacturing and selling pads to be used by nonambulatory persons have been aware that properly distributed support and ample air circulation can reduce the occurrence of decubitus ulcers. Once a sore has developed, increased air circulation can aid in the healing process.

An open-cell foam pad that has been cut to form an alternating array of flat-topped projections and ventilated depressions has been found to be beneficial in preventing the formation of decubitus ulcers. U.S. Pat. No. 4,686,724, issued to Bedford on Aug. 16, 1987, describes in detail the advantages of such a pad. Alternative pad designs, in addition to methods of manufacture, are disclosed in U.S. Pat. No. 4,603,445 issued to Spann on Aug. 5, 1986.

U.S. Pat. No. 3,266,064, issued to Figman on Aug. 16, 1966, discloses a rather complex design in which cooled or heated air is forced to the surface of a mattress from a ventilated box spring. Bedford, in copending application Ser. No. 123,052 filed on Nov. 19, 1987, discloses a ventilated pad utilizing multilayer all-foam construction incorporating a booster fan in its center.

Most of the disclosed designs fail to simultaneously provide for adequate weight distribution as well as adequate fresh airflow to the supported portions of the anatomy by relying on passive diffusion to move air throughout the pad. Those designs that do provide an additional boost to the airflow are complex devices and expensive to manufacture. The disclosed designs all lack the ability to tailor the amount of ventilation to a particular patient's needs.

SUMMARY OF THE INVENTION

It is an object of the present invention to provide a pad that both maximizes weight distribution of an anatomy in repose thereon and provides for significantly increased aeration of the skin areas in contact with the pad.

It is a further object of the present invention to provide for boosted airflow within the pad.

It is another object of the invention that the amount of boosted airflow can be tailored to a particular patient's needs.

It is a further object of the invention that the airflow boosting system can quickly and easily be detached from the pad.

According to the present invention, these objectives are achieved and the shortcomings of the prior art are overcome by a foam support pad having an upper surface with a series of flat-topped protuberances and valleys thereon. Reticulated foam material used for the entire foam pad facilitates airflow throughout the entire structure. Variable speed fans are positionable within the pad to selectively boost airflow. The pad is divided into detachable sectors for which sections of foam capable of accommodating a plurality of fans can be interchanged, and hence allow increased airflow to be delivered to a particularly needy part of the body. The fans and associated equipment can quickly and easily be detached from the foam material.

BRIEF DESCRIPTION OF THE DRAWINGS

Many of the attendant advantages of this invention will be readily appreciated as the invention becomes better understood by reference to the following detailed description when considered in conjunction with the accompanying drawings, in which like reference numerals designate like parts throughout the figures thereof and wherein.

DESCRIPTION OF THE PREFERRED EMBODIMENTS

Figure 1:
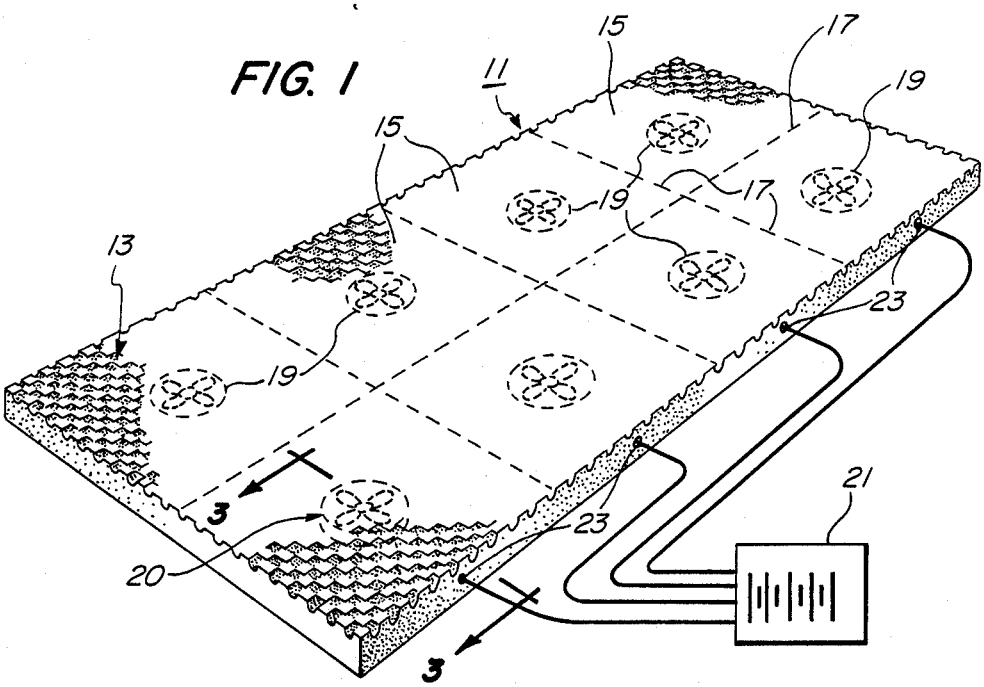
FIG. 1 is a perspective view of the structure of a preferred embodiment of this invention.

FIG. 1 illustrates the preferred embodiment of the nonambulatory support pad. The support pad 11 consists of a single layer of reticulated foam material.

Figure 2:
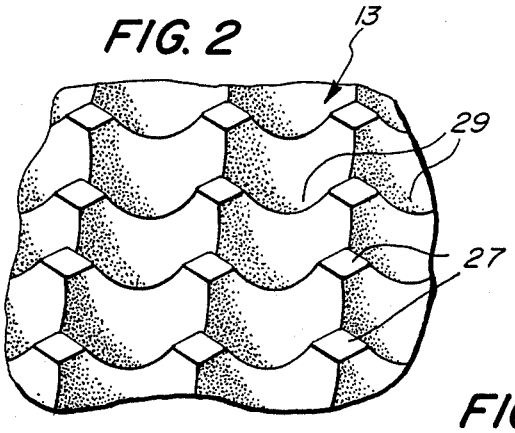
FIG. 2 shows the upper surface detail of the pad of FIG. 1.
Figure 4:
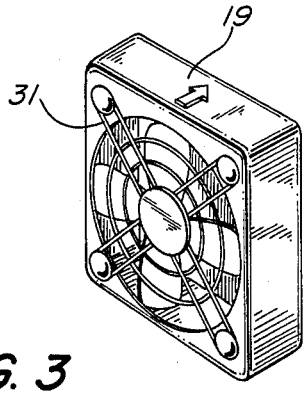
FIG. 4 shows a perspective view of a fan unit used in the embodiment.

The top surface of the pad 13 is illustrated in detail in FIG. 2. A uniform array of flat-topped protuberances is interspersed by an array of valleys 29. The pad is divided into a plurality of sectors 15 by a series of perforations 17. Each sector has at least one cutout 20 on its underside capable of accommodating an electric fan. Each fan is connectable to an electric power source 21 via connectors 23.

The top surface 13 of the foam pad 11 is intended to contact the anatomy of the individual in repose thereon. The arrangement of protuberances and depressions provides for the least amount of pressure to any one part of the body, while providing for maximum air circulation to those areas of the body contacting the surface of the pad. The area of each depression 29 is about $1\frac{1}{2}$ inches$\times 1\frac{1}{2}$ inches. The depth of each depression from the plane described by the flat-topped protuberances 27 to the base of the depressions is about one inch. Each flat-topped area is at least $\frac{1}{2}$ inch$\times\frac{1}{2}$ inch. In order. to support heavy individuals, the flat-topped areas may be increased in area. Preferably they should not exceed a diameter larger than $1\frac{1}{4}$ inches. It has been discovered that a skin area of 1¼ inches in diameter, even though denied air circulation, can sustain itself from air circulating in adjacent areas, whereas larger areas cannot. By limiting the individual flat-topped contact surfaces to this size or smaller, the user of even a nonreticulated foam pad is assured of obtaining sufficient oxygen to all parts of his body surface.

Figure 3:
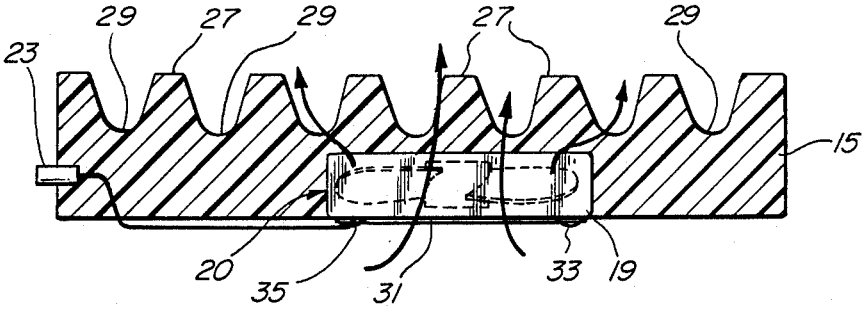
FIG. 3 shows a cross-section of the structure illustrated in FIG. 1.

FIG. 3 is a cross-section of a sector illustrating the placement of the fan therein. The fan 19 has a slightly raised screen portion 31 on both the intake, as well as the exhaust side.

The flow of fresh air into the depressions, as well as throughout the entire pad, is facilitated by the fact that the entire pad is formed of an open cell reticulated foam. The reticulated nature of the material allows relatively unrestricted air movement therethrough.

Each sector 15 is provided with a cutout section 20 on its underside. The dimensions of the cutout are such that a fan unit 19 has a snug fit therein. The snug fit is all that is required to retain the fan in the pad. On the other hand, the fan can easily be removed or interchanged as the need arises.

An additional feature of the fan unit 19 is the incorporation of a protective screen or grating 31. The grating is utilized on the top side to prevent the foam material from fouling rotating fan blades. It is utilized on the bottom side to facilitate air intake by slightly raising the fan unit above the plane defined by the bottom of the pad. The fan motor is interconnected to a power supply 21 via a connector 23. The jack can either be inserted in a cutout on the side of the pad as illustrated in FIG. 3, or simply run along the bottom of the pad for remote interconnection.

A further design consideration of the fan unit is that it be relatively moisture-resistant. A suitable design incorporates a 12V DC brushless motor. The Archer 273-243A is an example of a fan unit especially suited for this application. The unit measures 3¼ inches square, approximately 1 inch in depth, and draws about 2 watts.

Moisture resistance is also desirable in the jack design. Body fluids or other liquids draining from the patient could have an adverse effect upon contacting the associated electric componentry. The fan unit should be autoclavable so that its reuse with other patients is feasible.

Figure 7:
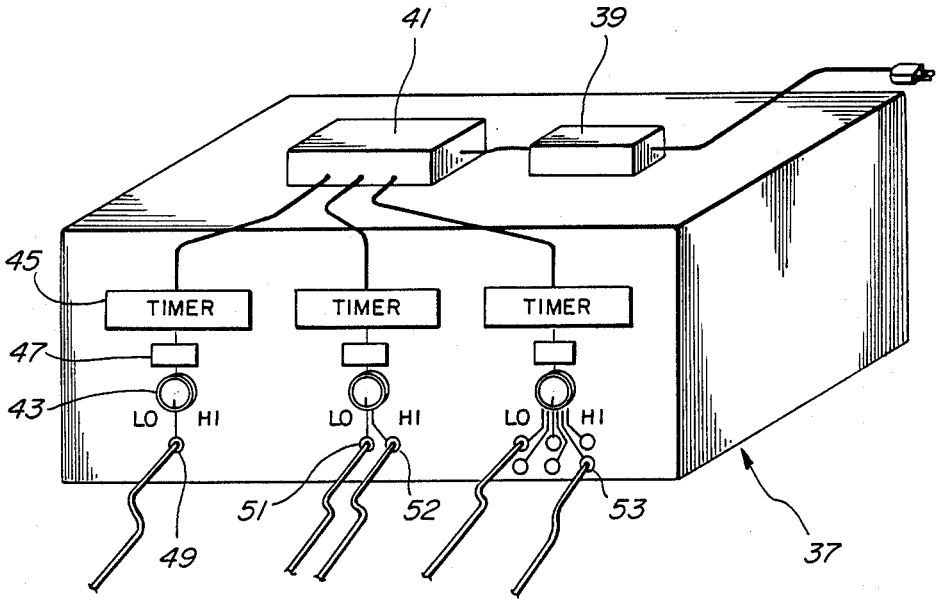
FIG. 7 is a perspective view of a power supply.

A means for adjusting the rate of rotation of the fan can be provided on or near the pad itself or in line with the cable interconnecting the power source. Alternatively, a variable output power source such as illustrated in FIG. 7 can be used. The power supply 37 incorporates rectifier circuitry 39 and voltage reduction circuitry 41. The voltage reduction circuitry reduces 110V AC to 8-12V DC. This power supply 37 is capable of supplying a plurality of fans. It can be housed in a single unit and, conversely, be placed near a patient's bed or hung on the bedframe footboard. The speed of each fan is adjustable via a rheostat 43 and additionally controlled by the function of a timer 45. A circuit breaker 47 protects each circuit. The timer, circuit breaker and rheostat can control the output of a single jack 49 or a pair of jacks 51, 52, or even six or more jacks as illustrated at 53.

The fan boosts airflow in and around the body in repose on pad 11. Air can be drawn into and through the fan via a variety of airflow patterns 33. Reference numeral 33 illustrates air being drawn laterally through the body of the pad around the protective screen 31, up through the fan and towards the top surface. Alternatively, air can be drawn in from the top of the pad, the reticulated structure freely allowing the air to flow through the depth of the pad, around the protective screen of the fan, and up through the fan to the patient.

A young, relatively mobile patient in repose upon the pad would require a minimal amount of boosted airflow. On the other hand, an elderly patient, perhaps having circulation problems in addition to being severely immobilized, would require a maximum amount of airflow to prevent the formation of decubitus ulcers. To that end, the fan speeds for all the fan motors would be adjusted to their maximum.

Alternatively, if it is decided that a single fan would not provide an adequate amount of airflow to a particular part of the body as, for example, the sacrum, where the formation of decubitus ulcers is common, the relevant sector 15 can be detached along its perforation lines and a sector accommodating a plurality of fans can be inserted in its place.

Figure 5:
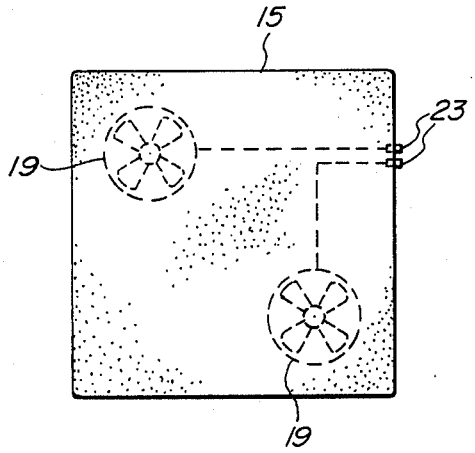
FIGS. 5 and 6 are top plan views of embodiments accommodating a plurality of fans.
Figure 6:
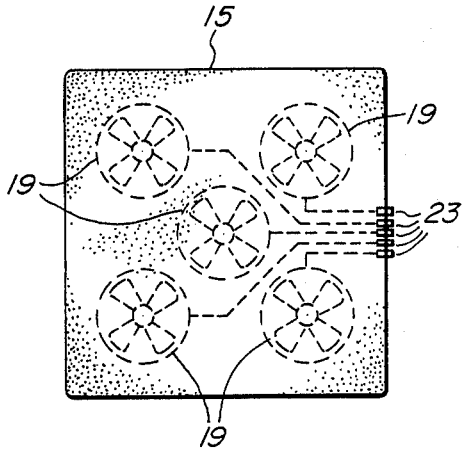

FIGS. 5 and 6 illustrate sectors of a pad capable of accommodating a plurality of fans. Two, three, four, and even five fans can easily be accommodated in a single sector.

The capability of this system to allow variation of each fan's speed, in addition to the option of adding additional fans, provides the versatility required to precisely tailor airflow to the needs of a particular patient.

A 72-inch×34-inch pad is preferably divided into eight sectors by the lines of perforations. Detachment along such perforation allows the selective interchange of a 18-inch×17-inch sector for one which can accommodate additional fans. A 2½-inch foam depth is sufficient to completely mask to a person in repose thereon the presence of a 1-inch-thick fan positioned within its cutout.

Obviously, many modifications and variations of the present invention are possible. In light of the above teachings, it is therefore to be understood that within the scope of the appended claims, the invention may be practiced otherwise than as specifically described.

What is claimed is:

1. A support pad for nonambulatory persons for providing different degrees of aeration to specific body parts as needed to prevent or cure decubitus ulcers, said pad comprising:

a reticulated foam layer sized to support all the body parts of a reclining person, said foam layer being divided into a plurality of sectors;

each sector of said foam layer being detachably connected to this adjacent sector; and electrically driven fans removably positioned in cutout portions on the bottom side of selected sectors of said foam layer for increasing airflow to the body.

2. The support pad of claim 1 wherein the sectors are detachable along a series of perforations.

3. The support pad of claim 1 wherein the reticulated foam layer has a top surface comprising an array of protuberances and depressions.

4. The support pad of claim 1 wherein the fans comprise variable speed electric fans.

5. The support pad of claim 1 wherein each of said detachably connected sectors may be detached and replaced by new reticulated foam sectors, each sector having one or more airflow booster means located therein as required to increase airflow to the body part overlaying the replaced sector.

6. The support pad of claim 1 wherein the reticulated foam layer has a top surface comprising an array of protuberances and depressions.

7. The support pad of claim 1 wherein the top surface of the reticulated foam sector comprises an array of flat-topped protuberances separated by depressions.

8. The support pad of claim 7 wherein the flat-topped protuberances are less than $1\frac{1}{4}$ inch in diameter.

9. The support pad of claim 1 wherein the pad has an overall dimension of 34 inches×72 inches and each detachable sector measures 17 inches×18 inches.

10. The support pad of claim 1 wherein each fan comprises a variable-speed electric fan unit, said fan rotatable about an axis perpendicular to the top surface of the pad.

11. The support pad of claim 10 wherein the cutout section on the bottom side of the foam sector is slightly smaller than the fan unit whereby the fan unit is held in place by friction against the foam and can therefore be easily and quickly removed.

12. The support pad of claim 10 wherein a remote variable voltage power supply provides the power required by the fan units.

* * * * *